US007418999B2

(12) United States Patent
Takano

(10) Patent No.: US 7,418,999 B2
(45) Date of Patent: Sep. 2, 2008

(54) HEAT EXCHANGER

(75) Inventor: Akihiko Takano, Saitama (JP)

(73) Assignee: Zexel Valeo Climate Control Corporation, Saitama (JP)

( * ) Notice: Subject to any disclaimer, the term of this patent is extended or adjusted under 35 U.S.C. 154(b) by 677 days.

(21) Appl. No.: 10/516,002

(22) PCT Filed: May 23, 2003

(86) PCT No.: PCT/JP03/06502

§ 371 (c)(1),
(2), (4) Date: Nov. 29, 2004

(87) PCT Pub. No.: WO03/102486

PCT Pub. Date: Dec. 11, 2003

(65) Prior Publication Data

US 2005/0211420 A1 Sep. 29, 2005

(30) Foreign Application Priority Data

May 31, 2002 (JP) ..... 2002-158722

(51) Int. Cl.
*F28F 9/02* (2006.01)

(52) U.S. Cl. ..... 165/110; 165/173; 165/174

(58) Field of Classification Search ..... 165/110, 165/173–175

See application file for complete search history.

(56) References Cited

U.S. PATENT DOCUMENTS 5,320,165 A * 6/1994 Hughes ..... 165/153
5,894,886 A * 4/1999 Chiba et al. ..... 165/174
6,068,050 A * 5/2000 Ghiani ..... 165/174
6,155,340 A * 12/2000 Folkedal et al. ..... 165/175
6,176,303 B1 * 1/2001 Kobayashi et al. ..... 165/175
6,234,238 B1 * 5/2001 Koyama et al. ..... 165/78
6,340,055 B1 * 1/2002 Yamauchi et al. ..... 165/174
6,446,713 B1 * 9/2002 Insalaco ..... 165/173
6,564,863 B1 * 5/2003 Martins ..... 165/175
6,640,887 B2 * 11/2003 Abell et al. ..... 165/175
7,044,209 B2 * 5/2006 Petersen ..... 165/173

FOREIGN PATENT DOCUMENTS

FR 2793015 A 11/2000
JP 5-17379 3/1993
JP 2000-337788 A 12/2000

* cited by examiner

*Primary Examiner*—Allen J Flanigan
(74) *Attorney, Agent, or Firm*—Kubotera & Associates, LLC

(57) ABSTRACT

A heat exchanger for a supercritical refrigerating cycle, comprising tubes 510 and tanks 520 which have plural hollow portions 520*a* and slots 521*a* for insertion of the ends of the tubes formed, wherein a sectional outline of the hollow portions of the tanks has an approximately semicircular shape with a side corresponding to the diameter directed to the side of the slots. And, the partition members each 523 is disposed between the plate bodies 521 and the tank member 522. The tanks are formed by assembling plate bodies 521 with slots formed and tank members 522 with plural curves formed to configure hollow portions, and the plate bodies are provided with communicating recesses 521*b* for communicating plural hollow portions. Besides, the partition members 523 for division of the hollow portions are disposed between the plate bodies and the tank members, holes 521*c*, 522*a* are formed in required portions of the plate bodies and the tank members, and plural projections 523*a* to be inserted through the individual holes are formed on the partition members and caulked after being inserted through the holes.

6 Claims, 14 Drawing Sheets

HEAT EXCHANGER

TECHNICAL FIELD

The present invention relates to a heat exchanger for a refrigerating cycle having a pressure of exceeding the critical point of a refrigerant on the high-pressure side.

BACKGROUND ART

As a heat exchanger such as a radiator, an evaporator or the like used for the refrigerating cycle, one provided with tubes for flowing a refrigerant and tanks with slots formed for insertion of the tube ends is known. The refrigerant is taken from a tank into the interior, performs heat exchange with heat conducted to the tubes and is discharged outside from the tank.

As the refrigerant for the refrigerating cycle, a fluorocarbon refrigerant including hydrochlorofluorocarbon has been used extensively. But it is now being replaced with $CO_2$ considering the global environment in these years.

A refrigerating cycle using $CO_2$ as the refrigerant has a very high inside pressure as compared with the refrigerating cycle using a fluorocarbon refrigerant, and particularly a pressure on a high-pressure side happens to exceed the critical point of the refrigerant depending on use conditions such as a temperature.

The critical point is a limit on the high-pressure side (namely, a limit on a high-temperature side) in a state that a gas layer and a liquid layer coexist and an end at one end of a vapor pressure curve. A pressure, a temperature and a density at the critical point become a critical pressure, a critical temperature and a critical density, respectively. Especially, when the pressure exceeds the critical point of the refrigerant in a radiator which is a high-temperature heat source of the refrigerating cycle, the refrigerant does not condense.

A heat exchanger used for such a supercritical refrigerating cycle is described in, for example, Japanese Patent Laid-Open Publication No. HEI 11-351783.

As to the heat exchanger for the refrigerating cycle, improvement of heat exchange efficiency of the refrigerant, miniaturization, weight reduction, facilitation of production and saving of mounting space are significant objects. Especially, a supercritical refrigerating cycle having a pressure on the high-pressure side exceeding the critical point of the refrigerant requires a very high compressive strength as compared with the refrigerating cycle using the fluorocarbon refrigerant. And the heat exchanger used therefor is required to secure pressure resistance and to be rationalized furthermore.

For example, the heat exchanger for the supercritical refrigerating cycle needs to reduce volumes of the tubes and the tanks and to increase their wall thickness in order to secure the pressure resistance. Therefore, it becomes somewhat difficult to fabricate the members constituting them, and it is desired that the individual component members are fabricated more efficiently at a heat exchanger manufacturing site.

The present invention has been made in view of the above circumstances and provides a heat exchanger which is configured rationally in conformity with the above-described subject so to be used for the supercritical refrigerating cycle.

DISCLOSURE OF THE INVENTION

The invention described in claim 1 of the present application is a heat exchanger for a refrigerating cycle having a pressure of exceeding the critical point of a refrigerant on a high-pressure side, wherein the heat exchanger is provided with tubes for flowing the refrigerant and tanks which have plural hollow portions and are provided with slots for inserting the ends of the tubes to perform heat exchange of the refrigerant with heat conducted to the tubes; and the sectional outline of each of the plural hollow portions of the tanks has an approximately semicircular shape with a side corresponding to the diameter directed to the side of the slots. The diameter-corresponding side according to the present invention is a side connecting both ends of a 180° arc or a line (e.g., a U-shape curve or the like) formed by slightly deforming the arc.

A rationally configured heat exchanger is obtained by the present invention. In other words, the heat exchanger of the present invention has the pressure resistance of the tank improved by dividing the interior of the tank into the plural hollow portions.

And, the sectional outline of the hollow portion of the tank is ideally circular in simple consideration of a compressive strength. In reality, however, the vicinity of the slots of the tanks is reinforced by the tubes because the tubes are inserted into the slots. Consequently, the sectional outline of the hollow portion is not circular but desirably has an approximately semicircular shape with the diameter-corresponding side directed to the side of the slots. Such a configuration is quite effective for a heat exchanger for a supercritical refrigerating cycle where the tank has a relatively small volume.

Thus, the present invention is a heat exchanger configured so that the sectional outlines of the plural hollow portions each have an approximately semicircular shape and has achieved a quite conspicuous effect as the heat exchanger for the supercritical refrigerating cycle.

The invention described in claim 2 of the present application is the heat exchanger according to claim 1, wherein the tanks each is formed by assembling plate bodies with the slots formed and tank members with plural curves configuring the hollow portions formed.

According to the present invention, a more rationally configured heat exchanger can be obtained. In other words, the tank having plural semicircular hollow portions can be formed efficiently by assembling the plate bodies and the tank members described above.

The invention described in claim 3 of the present application is the heat exchanger according to claim 2, wherein the plate bodies are provided with communicating recesses for communicating the plural hollow portions.

According to the present invention, a more rationally configured heat exchanger can be obtained. In other words, if the tank members, which are provided with plural curves, are provided with the communicating recesses, there is a disadvantage that the fabrication of the tank members becomes very complex. In this connection, when the plate bodies are provided with the communicating recesses, it becomes possible to fabricate relatively easily, and the above-described disadvantage can be avoided without fail. Thus, the heat exchanger of the present invention has the communicating structure of the plural hollow portions within the tanks rationalized.

The invention described in claim 4 of the present application is the heat exchanger according to claim 3, wherein the communicating recesses are counterbores formed to surround the slots.

According to the present invention, the plural hollow portions are communicated by the counterbores which are communicating recesses formed to surround the slots.

The invention described in claim 5 of the present application is the heat exchanger according to any one of claims 2 to 4, wherein partition members for dividing the hollow portions are disposed between the plate bodies and the tank members.

According to the present invention, the hollow portions of the tanks are divided into prescribed spaces by the partition members.

The invention described in claim 6 of the present application is the heat exchanger according to claim 5, wherein holes are formed in required portions of the plate bodies, the partition members are provided with projections to be inserted through the holes of the plate bodies, and the projections are caulked after being inserted through the holes.

According to the present invention, the projections of the partition members inserted through the holes of the plate bodies are caulked, so that the plate bodies and the partition members can be assembled firmly, and the productivity can be improved further.

The invention described in claim 7 of the present application is the heat exchanger according to claim 5 or 6, wherein holes are formed in required portions of the tank members, projections to be inserted through the holes of the tank members are formed on the partition members, and the projections are caulked after being inserted through the holes.

According to the present invention, the projections of the partition members inserted through the holes of the tank members are caulked, so that the tank members and the partition members can be assembled firmly, and the productivity can be improved further.

The invention described in claim 8 of the present application is a heat exchanger for a refrigerating cycle having a pressure of exceeding the critical point of a refrigerant on a high-pressure side, wherein the heat exchanger is provided with tubes for flowing the refrigerant and tanks which have plural hollow portions and are provided with slots for inserting the ends of the tubes to perform heat exchange of the refrigerant with heat conducted to the tubes; the tanks each is formed by assembling plate bodies which are provided with the slots and tank members which are provided with plural curves configuring the hollow portions; and the plate bodies are provided with communicating recesses for communicating the plural hollow portions.

According to the present invention, a rationally configured heat exchanger can be obtained. Specifically, if the communicating recesses are formed in the tank members provided with the plural curves, there is a disadvantage that the fabrication of the tank members becomes very complex. In this connection, forming of the communicating recesses in the plate bodies allows to fabricate relatively easily, and such a disadvantage can be avoided without fail. Thus, the heat exchanger of the present invention has the rationalized communicating structure of the plural hollow portions in the tanks.

The invention described in claim 9 of the present application is the heat exchanger according to claim 8, wherein the communicating recesses are counterbores formed around the slots.

According to the present invention, the plural hollow portions are communicated by the counterbores which are the communicating recesses formed to surround the slots.

The invention described in claim 10 of the present application is a heat exchanger for a refrigerating cycle having a pressure of exceeding the critical point of a refrigerant on the high-pressure side, wherein the heat exchanger is provided with tubes for flowing the refrigerant and tanks which have plural hollow portions and are provided with slots for inserting the ends of the tubes to perform heat exchange of the refrigerant with heat conducted to the tubes; the tanks each is formed by assembling plate bodies which are provided with the slots and tank members which are provided with plural curves configuring the hollow portions; partition members for dividing the hollow portions are disposed between the plate bodies and the tank members; and holes are formed in required portions of the plate bodies and the tank members, the partition members are provided with plural projections which are inserted through the holes of the plate bodies and the tank members, and the projections are caulked after being inserted through the holes.

According to the present invention, a rationally configured heat exchanger can be obtained. Specifically, the hollow portions in the tanks are divided into prescribed spaces by the partition members. And, the projections of the partition members inserted through the holes of the plate bodies and the projections of the partition members inserted through the holes of the tank members are caulked, so that the plate bodies, the tank members and the partition members can be assembled firmly. Thus, the productivity can be improved furthermore.

BEST MODE FOR CARRYING OUT THE INVENTION

Figure 1:
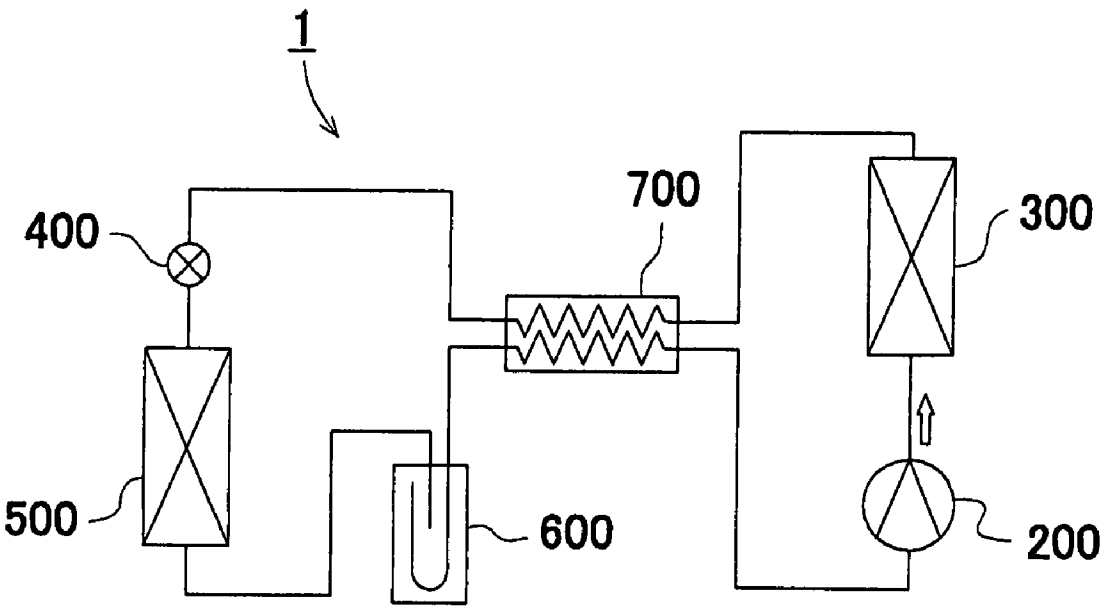
FIG. 1 is an explanatory view showing a supercritical refrigerating cycle according to an embodiment of the present invention.
Figure 2:
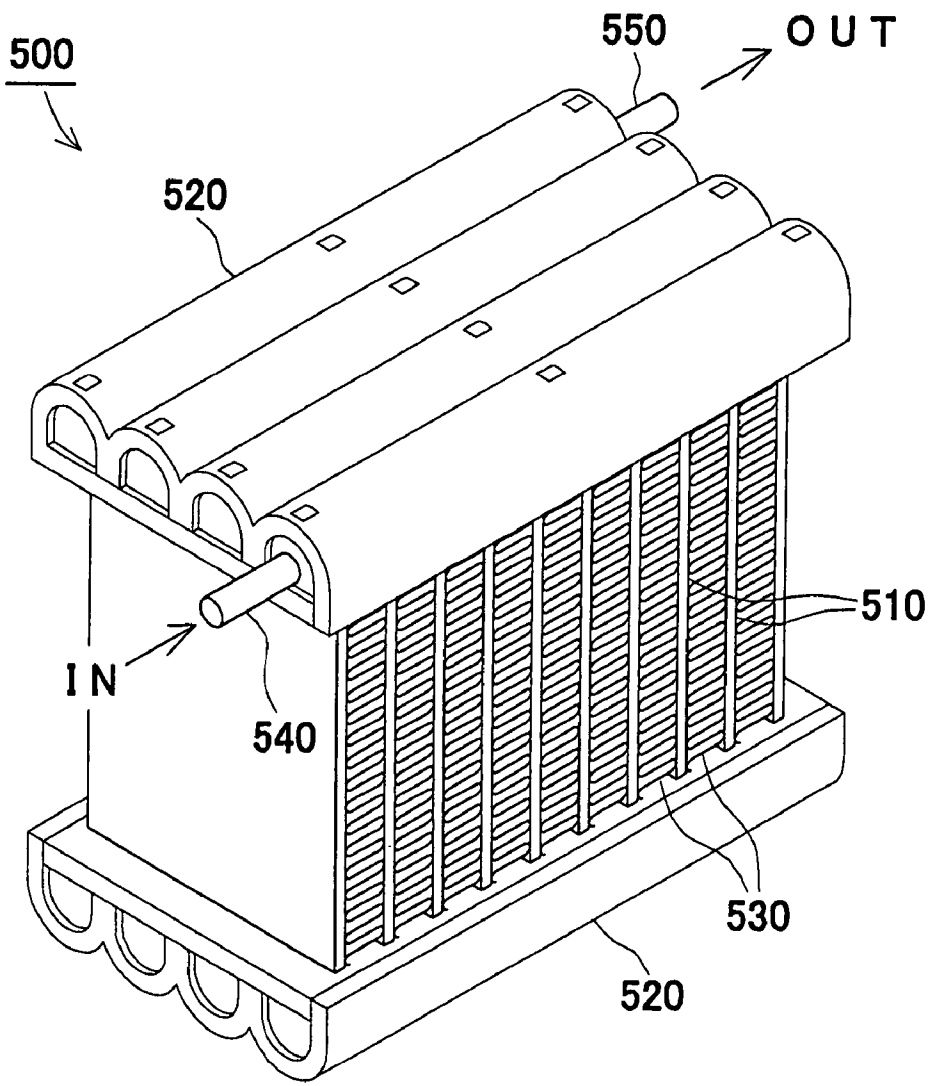
FIG. 2 is a perspective view showing an evaporator according to an embodiment of the present invention.
Figure 3:
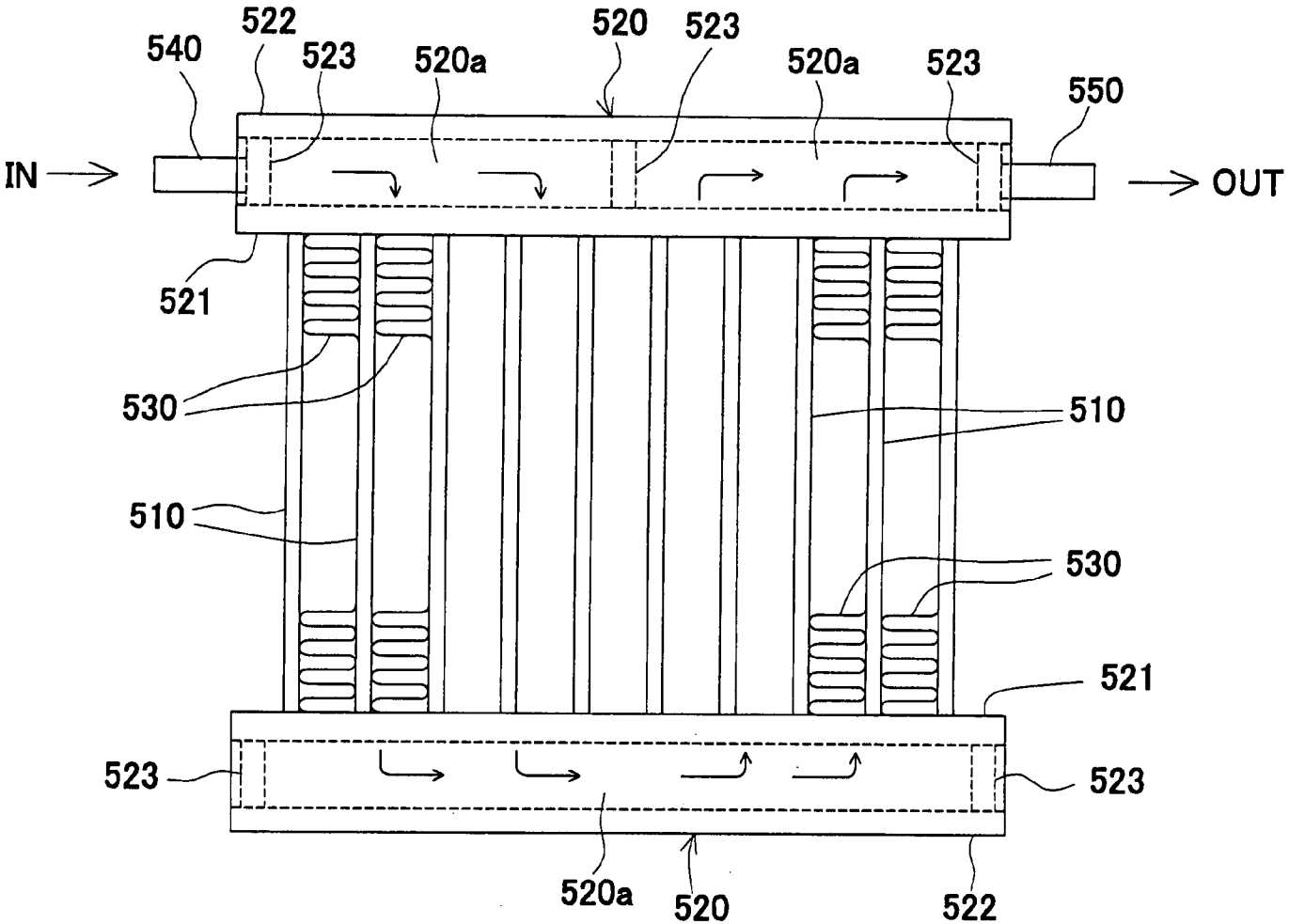
FIG. 3 is a front view showing the evaporator according to the embodiment of the present invention.
Figure 4:
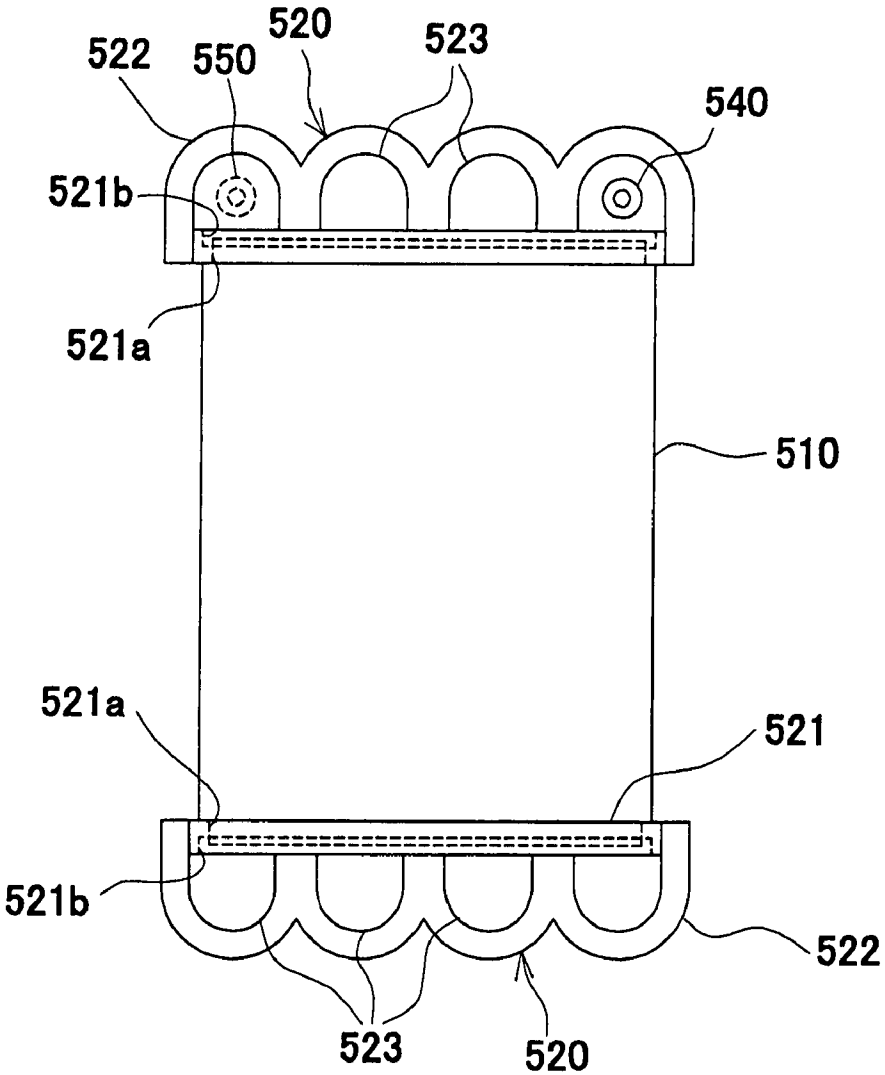
FIG. 4 is a side view showing the evaporator according to the embodiment of the present invention.
Figure 5:
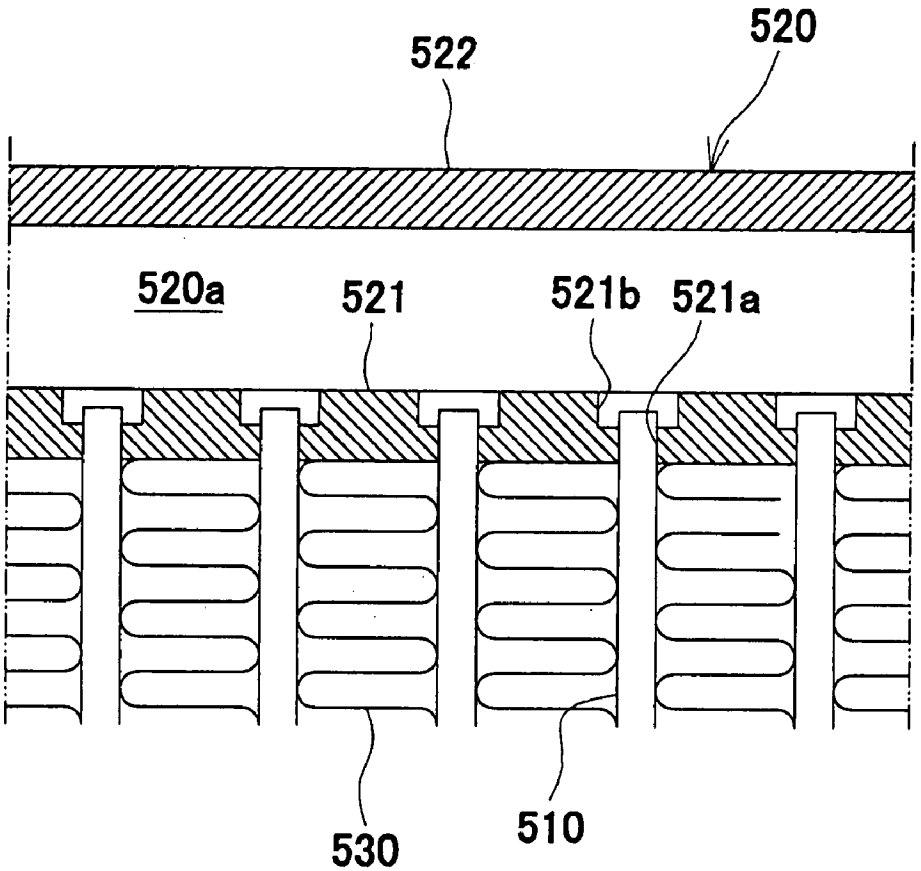
FIG. 5 is a front sectional view showing the main part of the evaporator according to the embodiment of the present invention.

An embodiment of the present invention will be described in detail with reference to the drawings. A refrigerating cycle 1 shown in FIG. 1 is a refrigerating cycle for in-car air conditioning mounted on an automobile. This refrigerating cycle 1 is provided with a compressor 200 for compressing a refrigerant, a radiator 300 for cooling the refrigerant compressed by the compressor, an expansion valve 400 for expanding by decompressing the refrigerant cooled by the radiator 300, an evaporator 500 for evaporating the refrigerant decompressed by the expansion valve 400, an accumulator 600 for separating the refrigerant flowing out of the evaporator 500 into a gas layer and a liquid layer and feeding the gas layer refrigerant to the compressor 200, and an inner heat exchanger 700 for heat-exchanging between the refrigerant on a high-pressure side and the refrigerant on a low-pressure side to improve the efficiency of the cycle. $CO_2$ is used as the refrigerant, and a supercritical refrigerating cycle is configured. The pressure on the high-pressure side of the supercritical refrigerating cycle 1 exceeds the critical point of the refrigerant depending on the use conditions such as a temperature.

As shown in FIG. 2 to FIG. 5, the heat exchanger is described in this specification with reference to an evaporator as an example.

The evaporator 500 of this example is provided with a plurality of flat tubes 510 for flowing the refrigerant and a pair of tanks 520 having a plurality of hollow portions 520*a* and with a plurality of slots 521*a* formed to insert individual ends of the tubes 510 so as to perform heat exchange of the refrigerant with heat conducted to the tubes 510. The plurality of tubes 510 are stacked with corrugated fins 530 with louvers formed being interposed between the tubes.

An inlet 540 and an outlet 550 for the refrigerant are disposed at required portions of the tanks 520.

Air is flown into the tubes 510 and the fins 530 by an unillustrated fan, and the refrigerant entered through the inlet 540 flows through the tubes 510 while performing heat exchange with heat conducted to the tubes 510 and the fins 530 and is discharged through the outlet 550.

The evaporator 500 is produced by assembling aluminum alloy members configuring the tubes 510, the tanks 520, the fins 530, the inlet 540 and the outlet 550 into one body and brazing the assembly in a furnace.

The tanks 520 each of this example is configured by assembling plate bodies 521 having the plurality of slots 521*a* formed at prescribed intervals, tank members 522 having a plurality of semicylindrical curves arranged in rows to configure the hollow portions 520*a*, and partition members 523 for dividing the hollow portions 520*a* to a prescribed length.

The plate body 521 is fitted to the tank member 522 to cover the open side of each curve, and the sectional outline of each of the plural hollow portions 520*a* has an approximately semicircular shape with a side corresponding to the diameter directed to the side of the slot 521*a*. And, the partition members 523 each is disposed between the plate body 521 and the tank member 522.

Besides, a counterbore 521*b* is formed to surround the individual slots 521*a* of the plate bodies 521. The counterbore 521*b* is a communicating recess which communicates the plural hollow portions 520*a*.

Specifically, the inlet 540 and the outlet 550 each is communicated with one of the hollow portions 520*a*, and the plural hollow portions 520*a* are mutually communicated via a gap between the plate body 521 and the tank member 522 formed by the counterbore 521*b*.

And, the refrigerant is brought from the upper tank 520 to the lower tank 520 through substantially a half the number of the tubes 510 and to the upper tank 520 through the remaining number of tubes 510.

Figure 6:
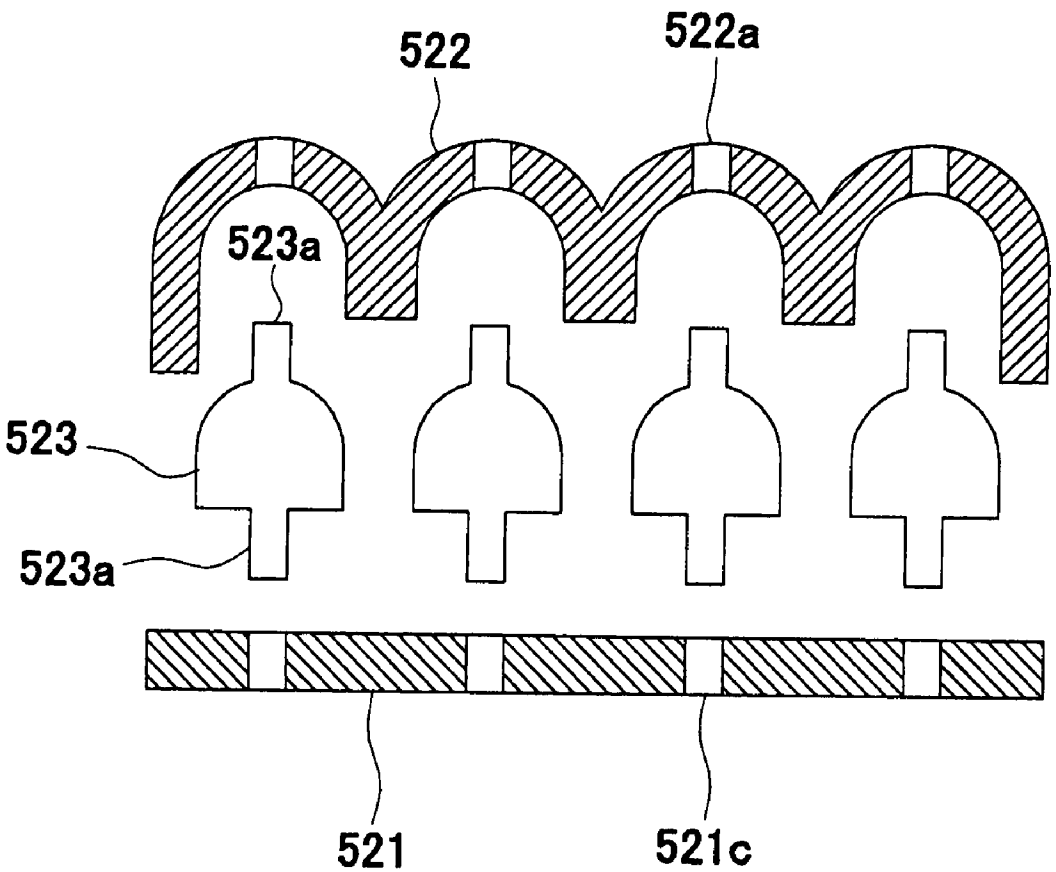
FIG. 6 is an exploded explanatory view showing a plate body, a tank member and a partition member according to an embodiment of the present invention.
Figure 7:
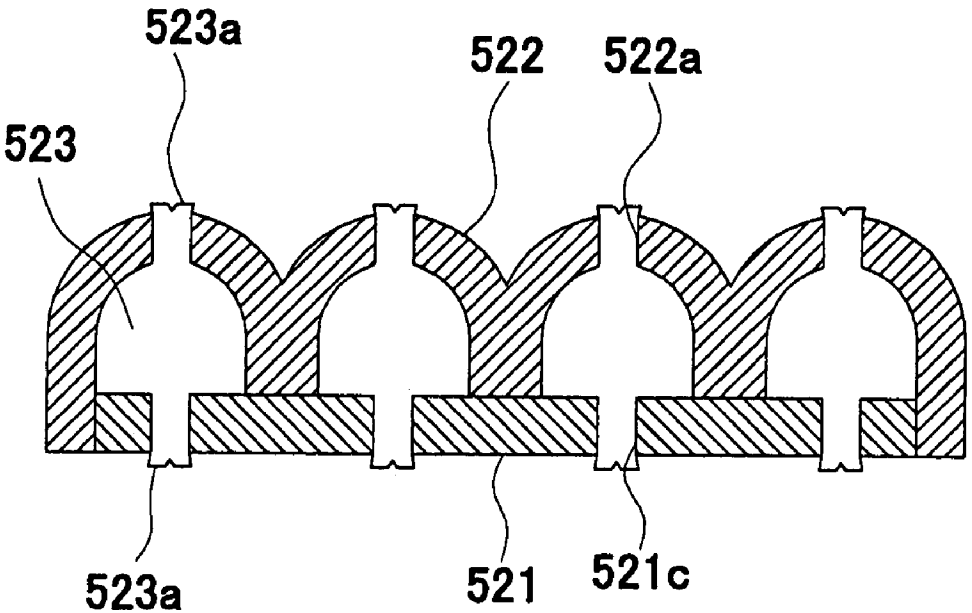
FIG. 7 is an explanatory view showing the plate body, the tank member and the partition member according to the embodiment of the present invention.

As shown in FIG. 6 and FIG. 7, holes 521*c*, 522*a* are formed in required portions of the plate body 521 and the tank member 522 in this example, and a plurality of projections 523*a* which are inserted through the holes 521*c* of the plate bodies 521 and the holes 522*a* of the tank member 522 are formed on the partition members 523. The holes 521*c*, 522*a* are formed by pressing or cutting. The projections 523*a* of the partition members 523 are inserted through the holes 521*c*, 522*a* of the plate body 521 and the tank member 522 and caulked by a jig.

By configuring as described above, the plate bodies 521, the tank members 522 and the partition members 523 can be assembled accurately and firmly.

Figure 8:
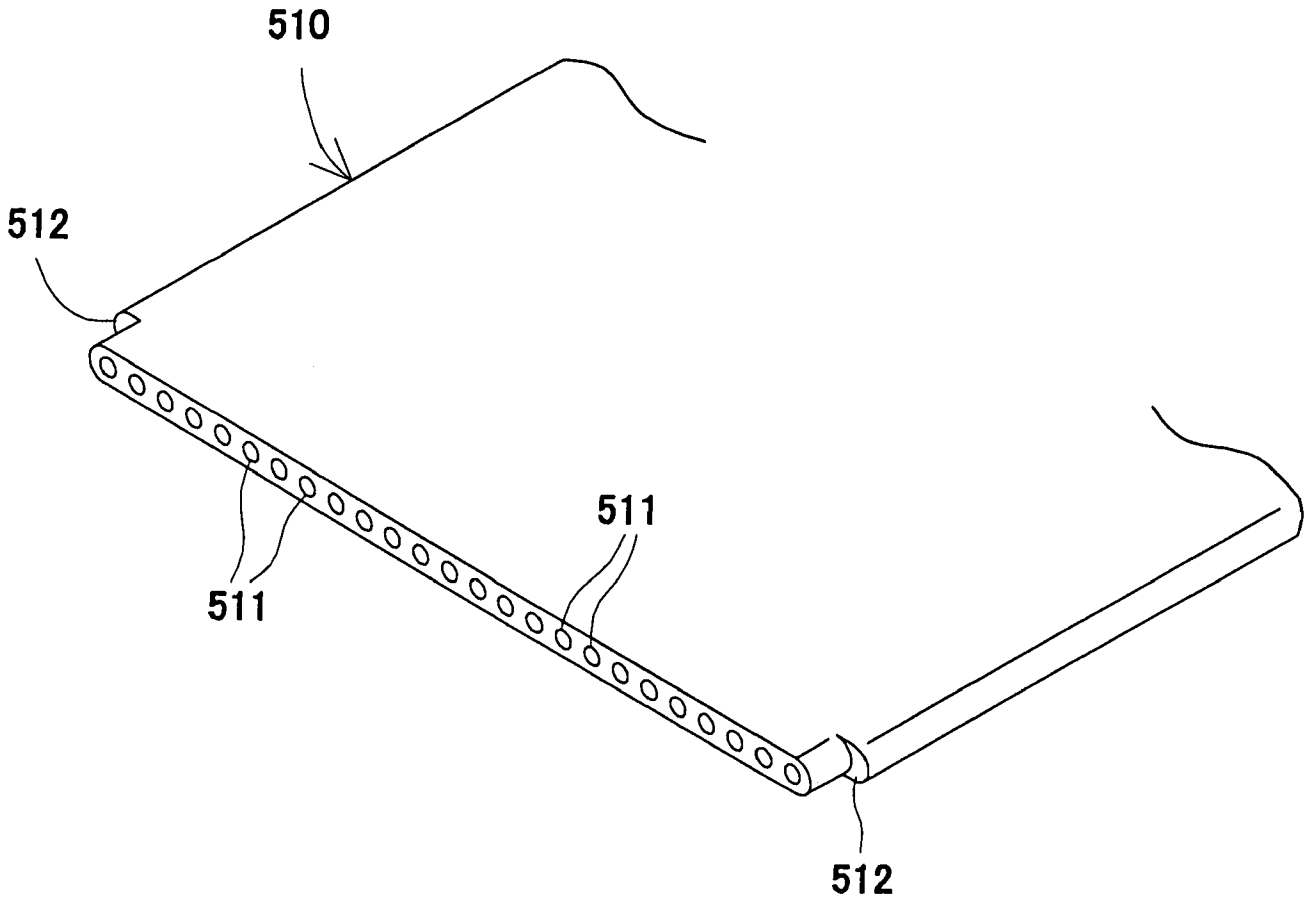
FIG. 8 is a perspective view showing a tube according to an embodiment of the present invention.

Meanwhile, the tubes 510 of this example are extruded members with a plurality of passages 511 formed as shown in FIG. 8. Step portions 512 which are pressed to the plate body 521 of the tank 520 are formed on ends of the tubes 510. An insertion amount of the ends of the tubes 510 into the slots 521*a* is limited by the step portions 512, and a prescribed interval is provided between the tubes 510 and the tank member 522.

The step portions 512 shown in the drawing are formed by fabricating after cutting the extruded members to a prescribed length. It is also possible to configure so as to form the step portions 512 when the extruded members are cut.

Figure 9:
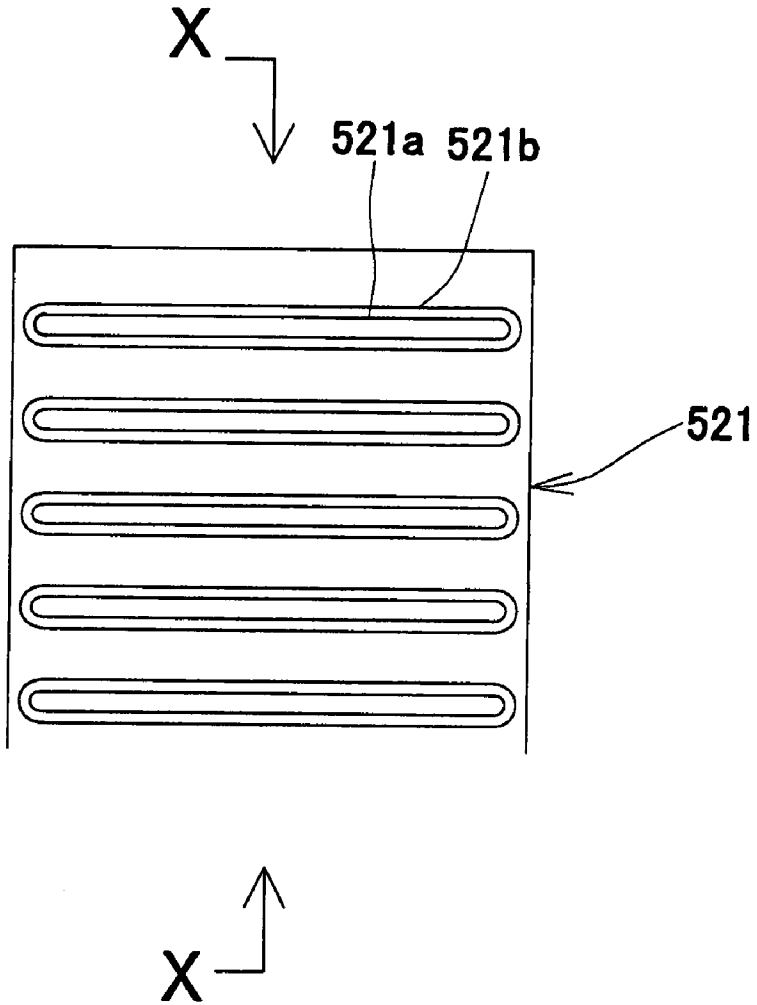
FIG. 9 is a front view showing the plate body according to an embodiment of the present invention.
Figure 10:
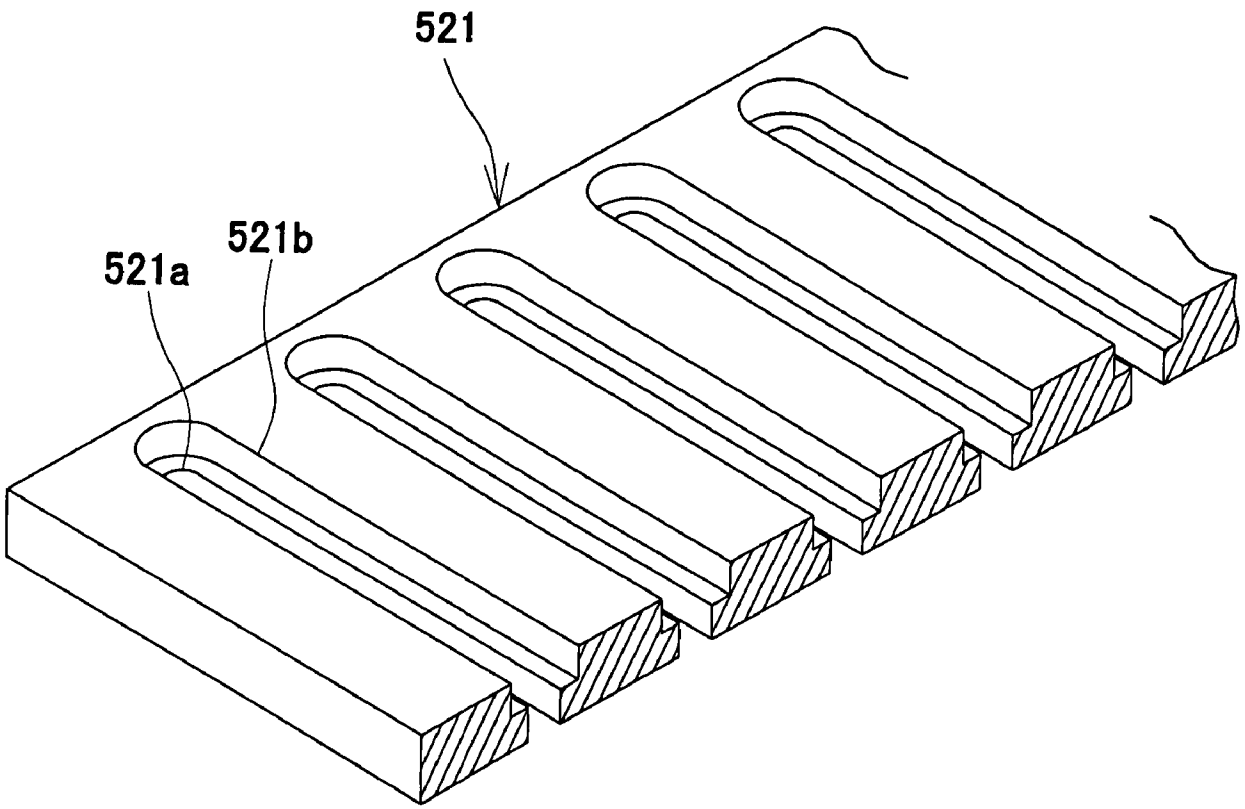
FIG. 10 is a perspective view showing the plate body (a section taken along line X-X of FIG. 9) according to the embodiment of the present invention.

As shown in FIG. 9 and FIG. 10, the plate body 521 of the tank 520 is formed of a material having a predetermined thickness with the slots 521*a* and the counterbores 521*b* formed therein by pressing or cutting.

Figure 11:
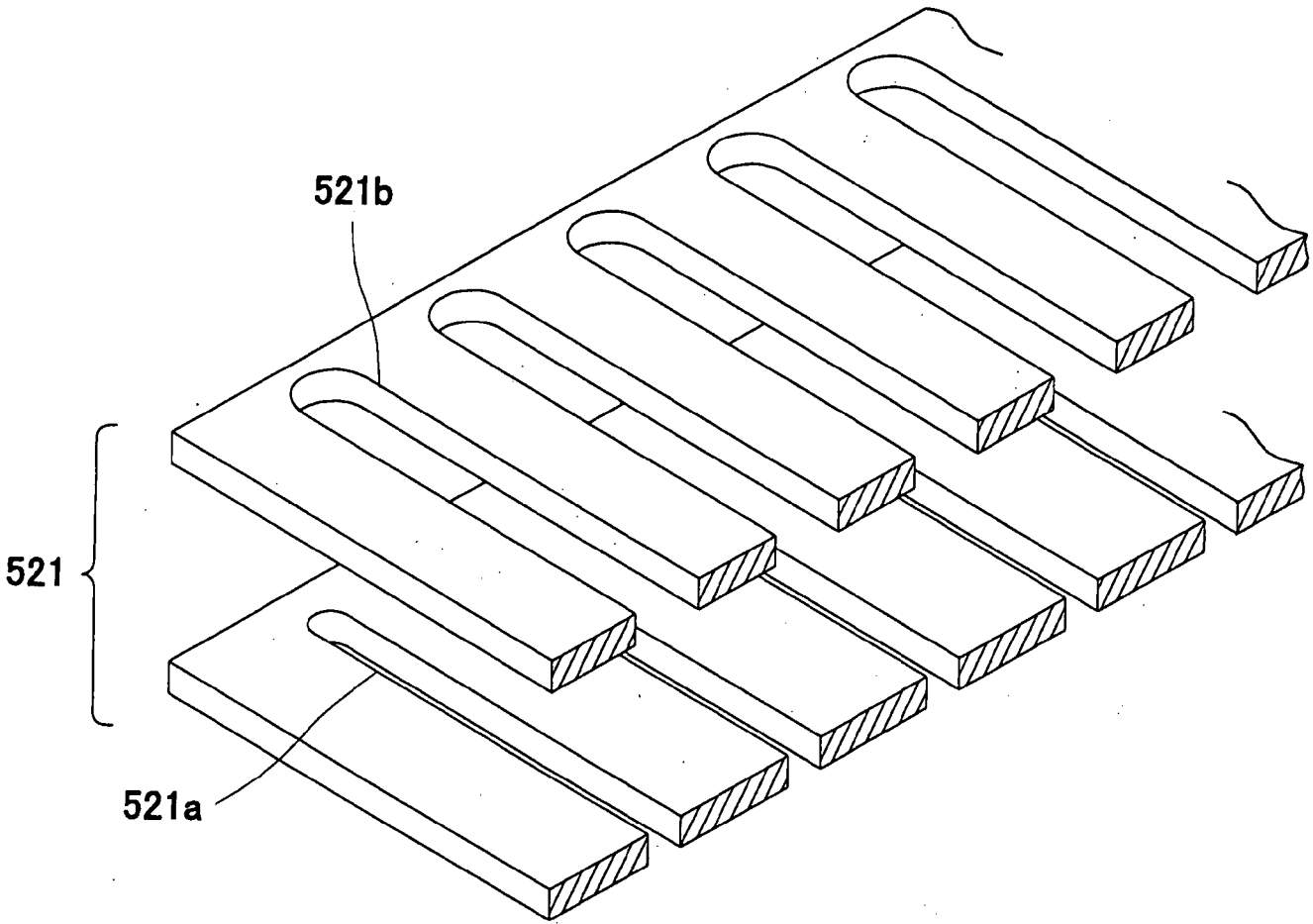
FIG. 11 is a perspective view showing the plate body according to the embodiment of the present invention.

Or, it may be configured to produce by laminating a material having the slots 521*a* formed by pressing and a material having the counterbores 521*b* formed by pressing as shown in FIG. 11. In this case, the individual materials are integrated by brazing as described above.

Figure 12:
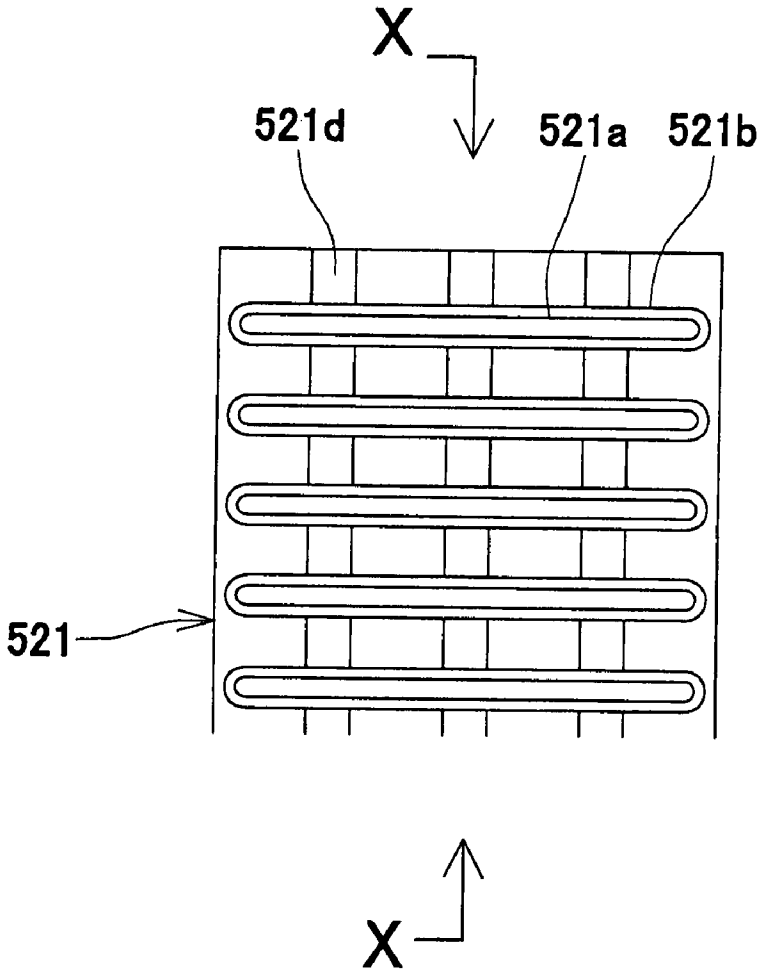
FIG. 12 is a perspective view showing the plate body according to the embodiment of the present invention.
Figure 13:
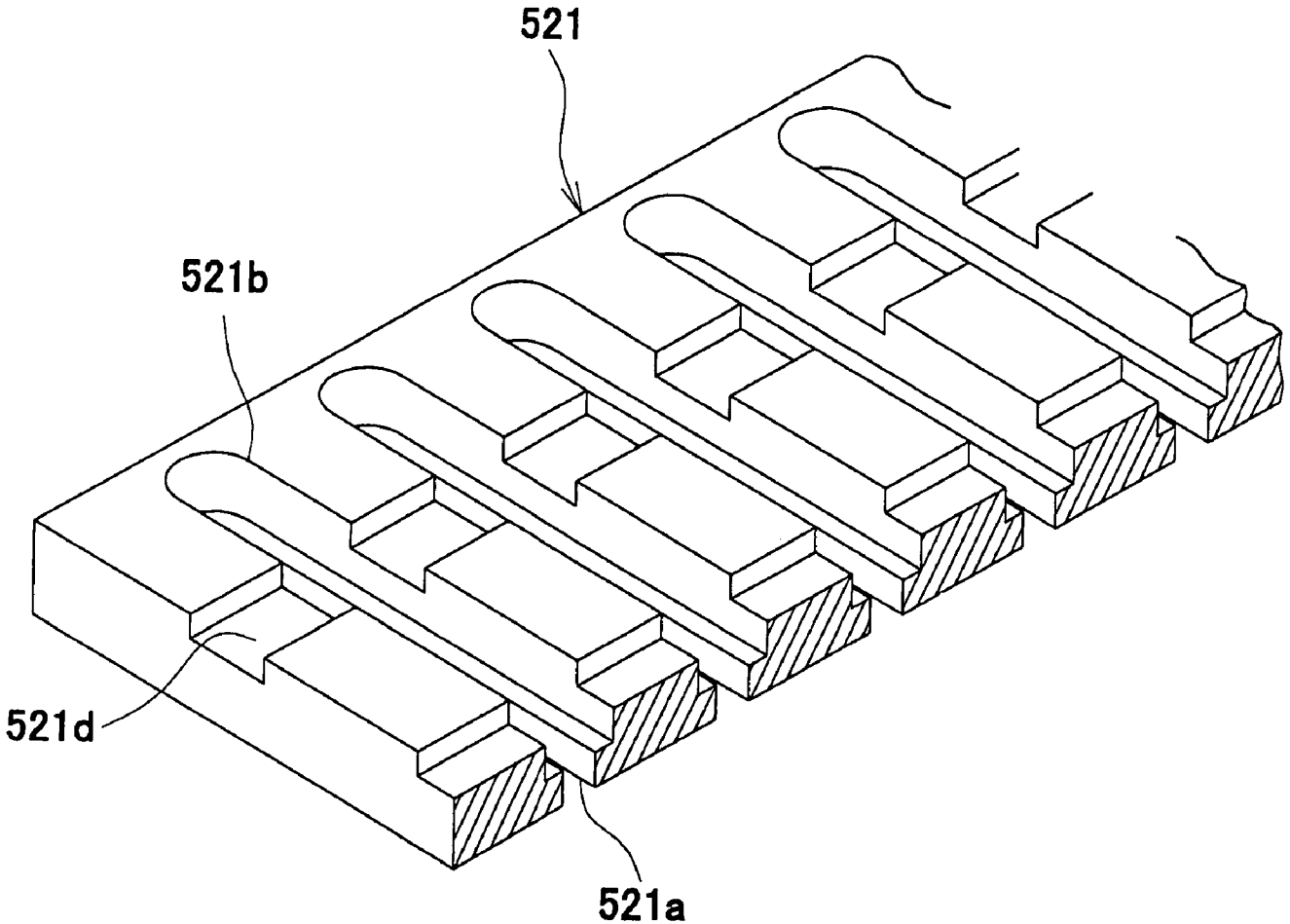
FIG. 13 is a perspective view showing the plate body (a section taken along line X-X of FIG. 12) according to the embodiment of the present invention.

Besides, groove-like fitting portions 521*d* for fitting the tank member 522 may formed on the surfaces of the plate bodies 521 as shown in FIG. 12 and FIG. 13. Forming of the fitting portions 521*d* on the plate body 521 allows improvement of an assembling property and a brazing property of the plate bodies 521 and the tank members 522.

The ends of the tubes 510 are inserted into the slots 521*a* of the plate bodies 521 and brazed in a state extending over the plural hollow portions 520*a*. The counterbores 521*b* formed to surround the slots 521*a* prevent a situation that the brazing material reaches the passages 511 of the tubes 510 when brazing, and the reliability of brazing is improved with certainty.

Figure 14:
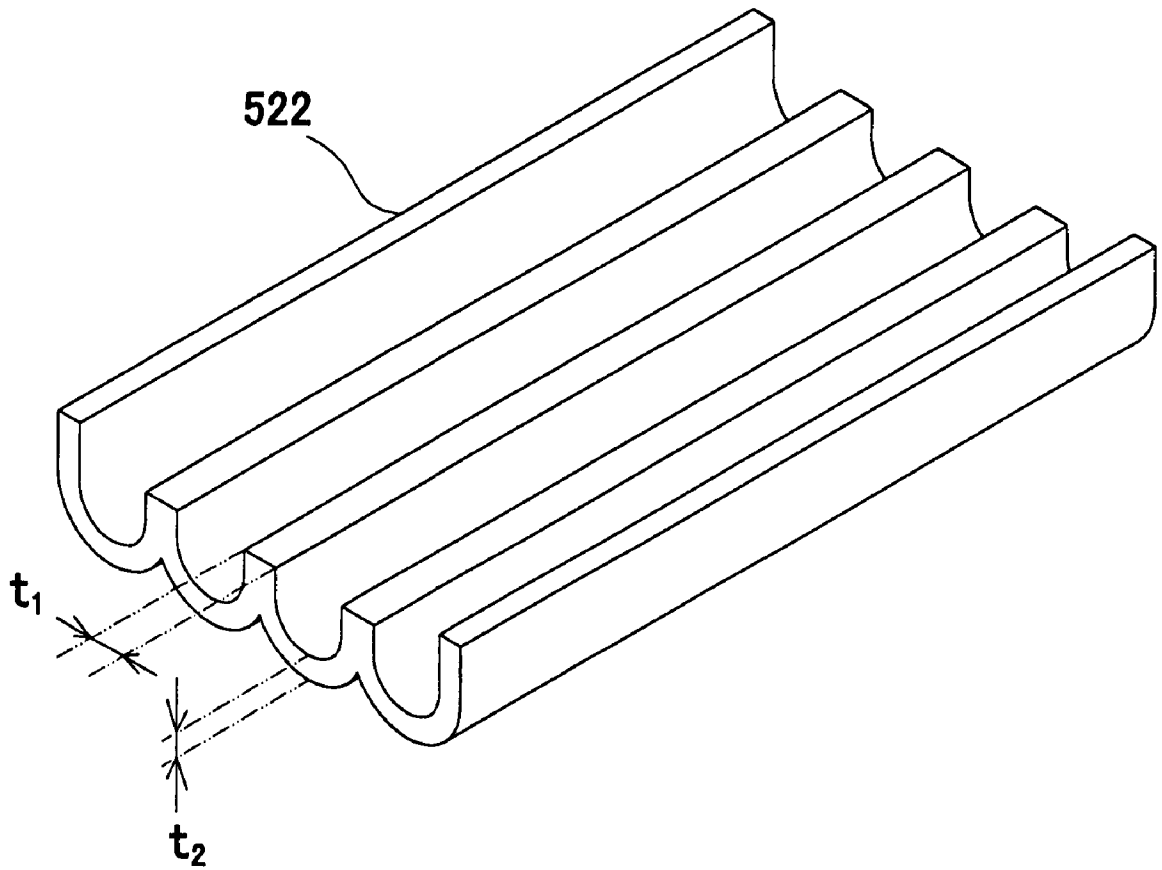
FIG. 14 is a perspective view showing the tank member according to the embodiment of the present invention.

As shown in FIG. 14, the tank member 522 of this example is formed of an extruded member. Thickness $t_1$ of the wall positioned between the hollow portions 520*a* and the hollow portions 520*a* of the tank member 522 is determined to be somewhat thicker than thickness $t_2$ of the other walls considering the pressure resistance. Specifically, $t_1$ is determined to be in a range of 1.3 to 1.8 times the $t_2$.

And, the counterbores 521*b* as the communicating recess are formed in the plate bodies 521, so that the plural hollow portions 520*a* can be communicated without making additionally fabricating steps to the extruded members. When the tank members 522 formed of the extruded members are fabricated, it is somewhat difficult in comparison with the fabrication of the plate bodies 521. But, with the configuration of this example, such a disadvantage can be avoided and makes a contribution to reduction of the fabrication cost.

Thus, the evaporator 500 of this example can secure the required pressure resistance according to the refrigerant which becomes into a supercritical state and achieve rationalization in connection with improvement of a heat exchange efficiency of the refrigerant, miniaturization, weight reduction, facilitation of production, saving of the mounting space and the like.

As described above, the present invention can be used quite suitably as a heat exchanger for a supercritical refrigerating cycle mounted on automobiles.

INDUSTRIAL APPLICABILITY

The present invention is a heat exchanger used for a supercritical refrigerating cycle and suitable for a heat exchanger such as a radiator, an evaporator and the like mounted on automobiles.

The invention claimed is:

1. A heat exchanger for a refrigerating cycle having a pressure of exceeding a critical point of a refrigerant on a high-pressure side, wherein:

the heat exchanger is provided with tubes for flowing the refrigerant and tanks which have a plurality of hollow portions and are provided with slots for inserting ends of the tubes to perform heat exchange of the refrigerant with heat conducted to the tubes;

a sectional outline of each of the plural hollow portions of the tanks has an approximately semicircular shape with a side corresponding to a diameter directed to a side of the slots, each of said tanks being formed by assembling plate bodies with the slots formed and tank members with a plurality of curves configuring the hollow portions; and the plate bodies are provided with communicating recesses for communicating with the plurality of hollow portions, said communicating recesses being counterbores formed to surround the slots.

2. The heat exchanger according to claim 1, wherein partition members for dividing the hollow portions are disposed between the plate bodies and the tank members.

3. The heat exchanger according to claim 2, wherein holes are formed in required portions of the plate bodies, the partition members are provided with projections to be inserted through the holes of the plate bodies, and the projections are caulked after being inserted through the holes.

4. The heat exchanger according to claim 2, wherein holes are formed in required portions of the tank members, projections to be inserted through the holes of the tank members are formed on the partition members, and the projections are caulked after being inserted through the holes.

5. A heat exchanger for a refrigerating cycle having a pressure of exceeding a critical point of a refrigerant on a high-pressure side, wherein:

the heat exchanger is provided with tubes for flowing the refrigerant and tanks which have a plurality of hollow portions and are provided with slots for inserting ends of the tubes to perform heat exchange of the refrigerant with heat conducted to the tubes;

the tanks each is formed by assembling plate bodies which are provided with the slots and tank members which are provided with a plurality of curves configuring the hollow portions; and the plate bodies are provided with communicating recesses for communicating the plural hollow portions, said communicating recesses being counterbores formed to surround the slots.

6. The heat exchanger according to claim 3, wherein holes are formed in required portions of the tank members, projections to be inserted through the holes of the tank members are formed on the partition members, and the projections are caulked after being inserted through the holes.

* * * * *